US006049955A

United States Patent [19]

Bowen

[11] Patent Number: 6,049,955

[45] Date of Patent: Apr. 18, 2000

[54] LACE SUBSTITUTE SHOE FASTENING MECHANISM II

[76] Inventor: Richard Bowen, 331 Varick St., Jersey City, N.J. 07302

[21] Appl. No.: 09/206,122

[22] Filed: Dec. 5, 1998

[51] Int. Cl.[7] ..... A43C 11/00; A44B 21/00

[52] U.S. Cl. ..... 24/712; 24/68 SK; 24/712.5; 24/713.6

[58] Field of Search ..... 24/68 SK, 68 CD, 24/712.5, 713.6, 712, 712.1

[56] References Cited

U.S. PATENT DOCUMENTS

| | | | |
|---|---|---|---|
| 805,275 | 11/1905 | Fisher | 24/712.5 |
| 2,164,123 | 6/1939 | Rio | 24/712.5 |
| 2,673,381 | 3/1954 | Dueker | 24/712 |
| 2,994,935 | 8/1961 | Buchholz | 24/712.5 |
| 3,103,725 | 9/1963 | Robb et al. | 24/712.5 |
| 3,861,003 | 1/1975 | Boden | 24/712.5 |
| 4,326,320 | 4/1982 | Riedel . | |
| 4,665,590 | 5/1987 | Udelhofen et al. | 24/712.5 |
| 4,987,653 | 1/1991 | Lin | 24/68 CD |
| 5,353,483 | 10/1994 | Louviere . | |

*Primary Examiner*—Victor N. Sakran

[57] ABSTRACT

This shoe fastening device particularly for conventional shoes such as sneakers and similar footwear comprises a pair of track members each longitudinally secured to a flap of an associated shoe, and a pair of corresponding slidable members each located within a respective track member and laterally set apart at a predetermined distance. Since the fastening of most conventional shoes is effected by laterally directing together their parallel and opposing flaps, the present invention achieves this by laterally and fixedly setting apart the slidable members at a distance less than that between said track members when track members are secured to their respective flaps and when shoe is in a normal unfastened state, and subsequently slidably positioning them within their respective tracks, and directing them along a path parallel to the longitudinal median of shoe. As a consequence the track members experience lateral forces directing them towards each other. The slidable members are laterally and fixedly set apart by securing a top surface of each to the undersurface of a bridge member so that they are parallel to each other and laterally set apart from each other. Slidable members are secured to bridge member via interlocking grooves and protuberances located on the top surface of each, and which interlockingly engage corresponding grooves and protuberances located on the undersurface of bridge member. A pawl means is pivotally secured to the bridge member and prevents movement of bridge member and any adjuncts in a direction towards front of associated shoe when pawl means is at the limit of its downward rotation, but allows movement both towards front and back of shoe when it is upwardly rotated.

11 Claims, 9 Drawing Sheets

LACE SUBSTITUTE SHOE FASTENING MECHANISM II

SUMMARY OF THE INVENTION

In view of the foregoing disadvantages inherent in the known types of conventional shoe fastening devices now present in the prior art the present invention provides a shoe lacing apparatus wherein the same employs use of a pair of tracks each longitudinally secured to one flap of a shoe, a pair of slidable members each slidably confined within one of the tracks, and a bridge member which secures the slidable members laterally apart at a distance less than that between the track members when shoe is in normal unfastened state. When bridge member and secured slidable member are rotated towards track members and subsequently directed along axes parallel to the longitudinal median situated between them the track members experience lateral forces directing them towards the longitudinal median resulting in the directing together of opposing flaps of shoe.

BACKGROUND—Field of Invention

This invention is related to the field of shoe securing and fastening devices, and pertains more particularly to a lace substitute for conventional shoes constructed with dual flaps on opposing sides of a tongue.

BACKGROUND—Discussion of Prior Art

Many shoe lacing systems have been designed to provide a faster and more convenient way of securing a shoe onto the foot. The vast majority of these systems are "lace closure systems" which accomplish this task in part by means of a lace or pliable fibre through which tension is applied. Some examples not withstanding are U.S. Pat. Nos. 5,353,483; 5,469,640; and 5,471,769. Problems inherent in lace closure systems include unwanted tightening of knots caused by tension in laces occurring through everyday use of shoe, and weakening and eventual breakage of lace at points where lace rubs against eyelets of shoe. Lace closure systems may also be impractical and undesirable by persons with rheumatoid arthritis, or persons with weight problems, or injuries which make it difficult for them to bend over for the period of time required to perform lace closure.

Both U.S. Pat. Nos. 5,148,614 and 5,529,094 are designed to achieve relatively rapid fastening by non lace closure methods, but U.S. Pat. No. 5,148,614 still requires somewhat meticulous finger activity and pressure to adjust the strap and effect secure fastening of flaps. U.S. Pat. No. 5,529,094 on the other hand has the convenience of unitary motion for the fastening of a shoe but employs use of many small moving parts which increases the risk of something going wrong rendering the device useless. U.S. Pat No. 4,999,889 uses a lever but still employs use of a lace as an integral means for the transferring of tension and the consequent directing together of opposing flaps and fastening of shoe. This intermediate process is totally eliminated in the present invention and thus eliminates the problems inherent with lace closure methods as mentioned above.

The present invention attempts to overcome the above described deficiencies by describing a shoe fastening system which effects rapid fastening and loosening with contiguous motion, has few moving parts, and which is constructed out of a rigid durable material such as plastic molding, composite material, or even metal.

BACKGROUND—Objects and Advantages

It is therefore an object of the present invention to provide a new and improved shoe fastening device which effects rapid fastening and loosening of shoe with contiguous motion.

Another object of the present invention is to provide a new and improved shoe fastening device that is durable and reliable in construction and in particular more durable than conventional lacing systems.

Yet another object of the present invention is to provide a new and improved shoe fastening device which offers adjustable tensioning in such a way so as to allow user to comfortable fasten shoe onto foot.

A further object of the invention is to provide a new and improved shoe fastening device that allows fastening using gross motor hand activity.

Still yet another object of the invention is to provide a new and improved shoe fastening device which can be easily and cost effectively manufactured.

These together with other objects of the invention, along with the features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

DETAILED DESCRIPTION OF THE FIRST EMBODIMENT

The present invention will now be described. It should be noted however that present invention for the most part is a symmetrical object and as such much of its description will be focused on one of the symmetrical portions with the understanding that similarly located parts on the opposing symmetrical portion work together in a fashion similar to that of the described portion, with the only difference being that the result(s) of operation of one symmetrical portion is laterally inverted to that of the other. The only exceptions to the symmetry of device are the tooth members (34) and the pawl means (30) as illustrated in FIGS. 1, 3C, 4 and 5, and which will be described in detail later.

Figure 1:
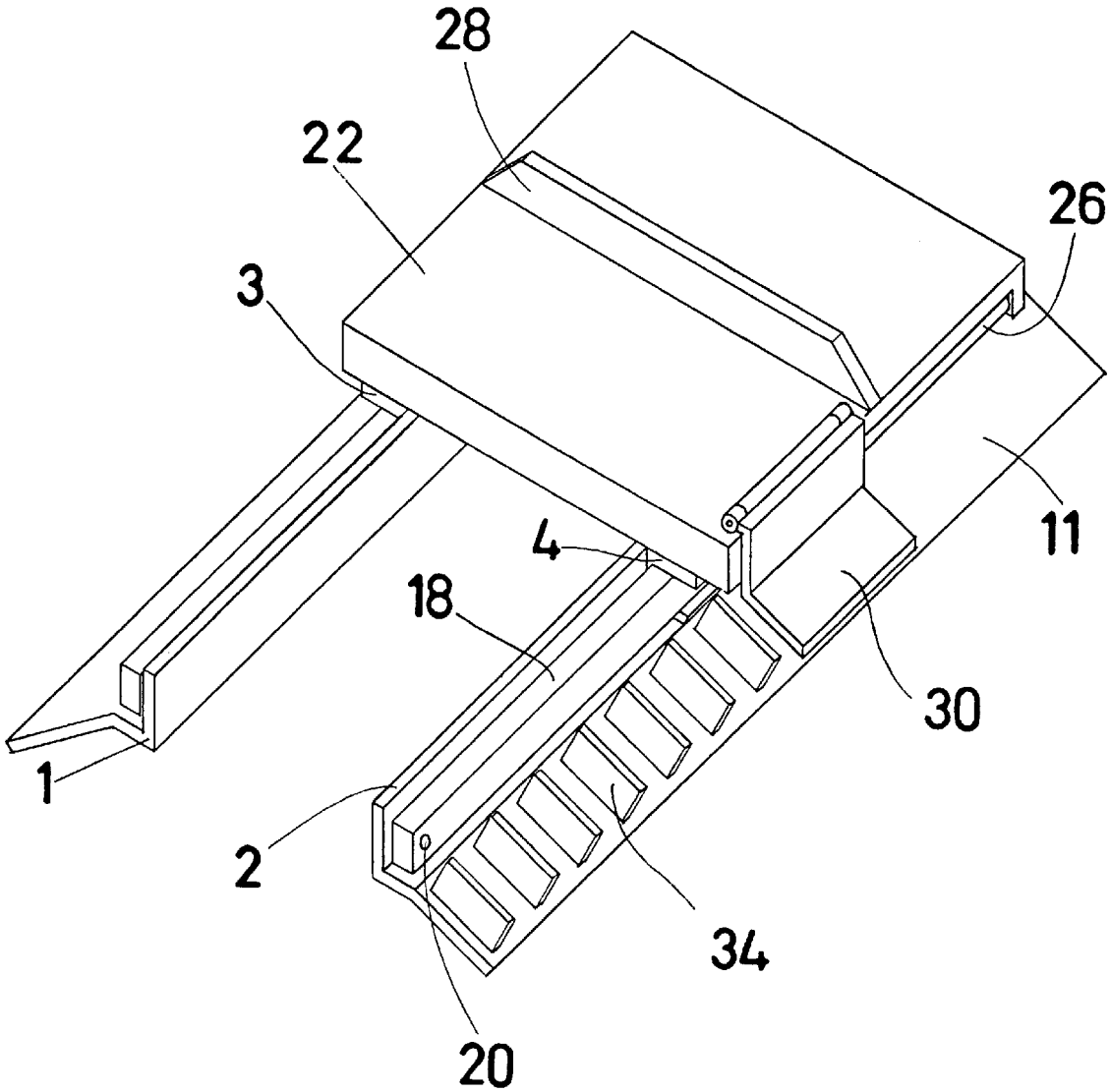
FIG. 1 is an isometric view of the first embodiment of the invention.
Figure 2:
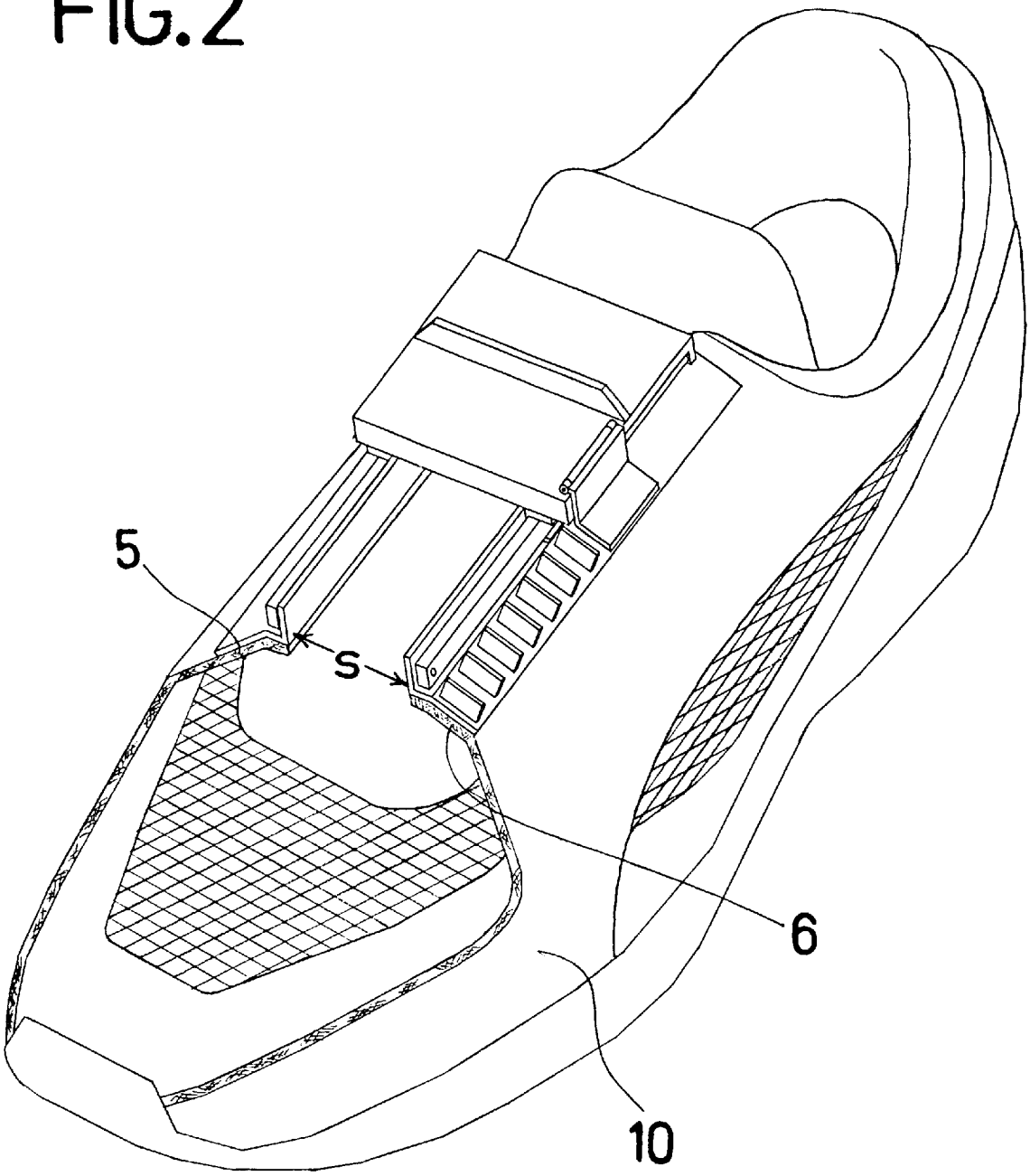
FIG. 2 is an isometric view of the first embodiment of the invention on a conventional shoe.

With reference to FIGS. 1 and 2 a shoe fastening mechanism comprises a pair of tracks (1) and (2) which are secured to the flap portions (5) and (6) of an associated shoe (10) respectively. Track (2) which is illustrated in FIGS. 3B and 3C comprises three track members which are essentially three elongate rectangular planar members (7), (8), and (9) where (7), and (9) are each joined by one of their longitudinal edges to an opposing longitudinal edge of (8) in such a way that (7) and (9) are parallel to each other and are both located on the same side of (8), and are both perpendicular to (8). The resulting integral formed by planar members (7), (8), and (9) has three respective inner adjacent elongate track surfaces (7'), (8'), and (9'), each perpendicular to its adjacent surface as indicated in FIG. 4, and where the longitudinal axis of each surface is parallel to that of the other. Also planar member (8) is vertically orientated, and as such the perpendicularly attached members (7) and (9) and their corresponding surfaces (7') and (9') are horizontal as shown in FIG. 4. Also in FIG. 4 it can be seen that flap portion (6) is secured to the undersurface of (9) and the undersurface of a track mount (11) where track mount (11) consists of another rectangular planar member joined by one of its longitudinal edges to the other longitudinal edge of (9). Member ( 11) is at an angle to member (9) as illustrated.

Figure 3A:
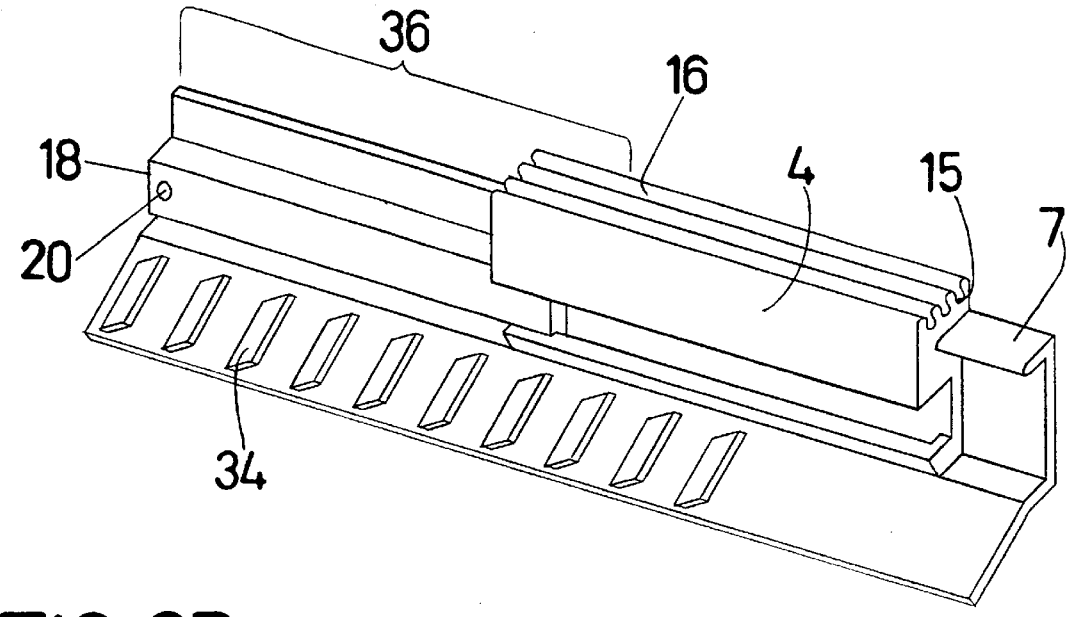
FIG. 3A is an isometric view of one symmetrical track of the first embodiment of the invention with its slidably located corresponding slidable member in an extended position.
Figure 3B:
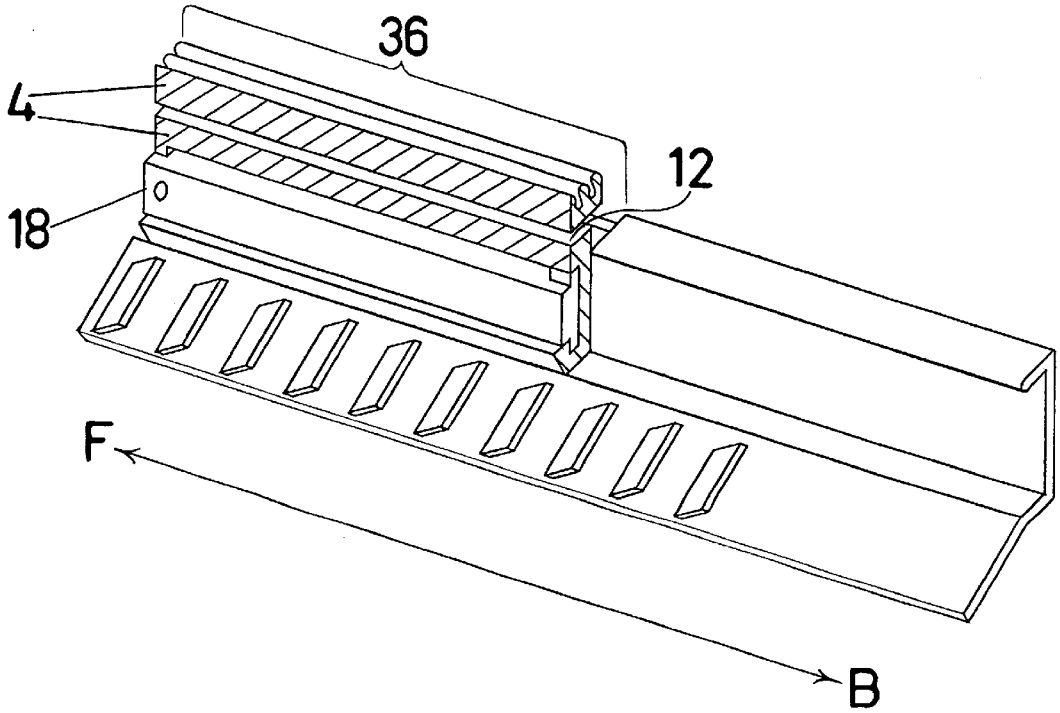
FIG. 3B is an isometric view of the symmetrical track shown in FIG. 3B, but with its slidably located corresponding slidable member in a retracted position. Slidable member is illustrated with a side section and cross section removed.
Figure 3C:
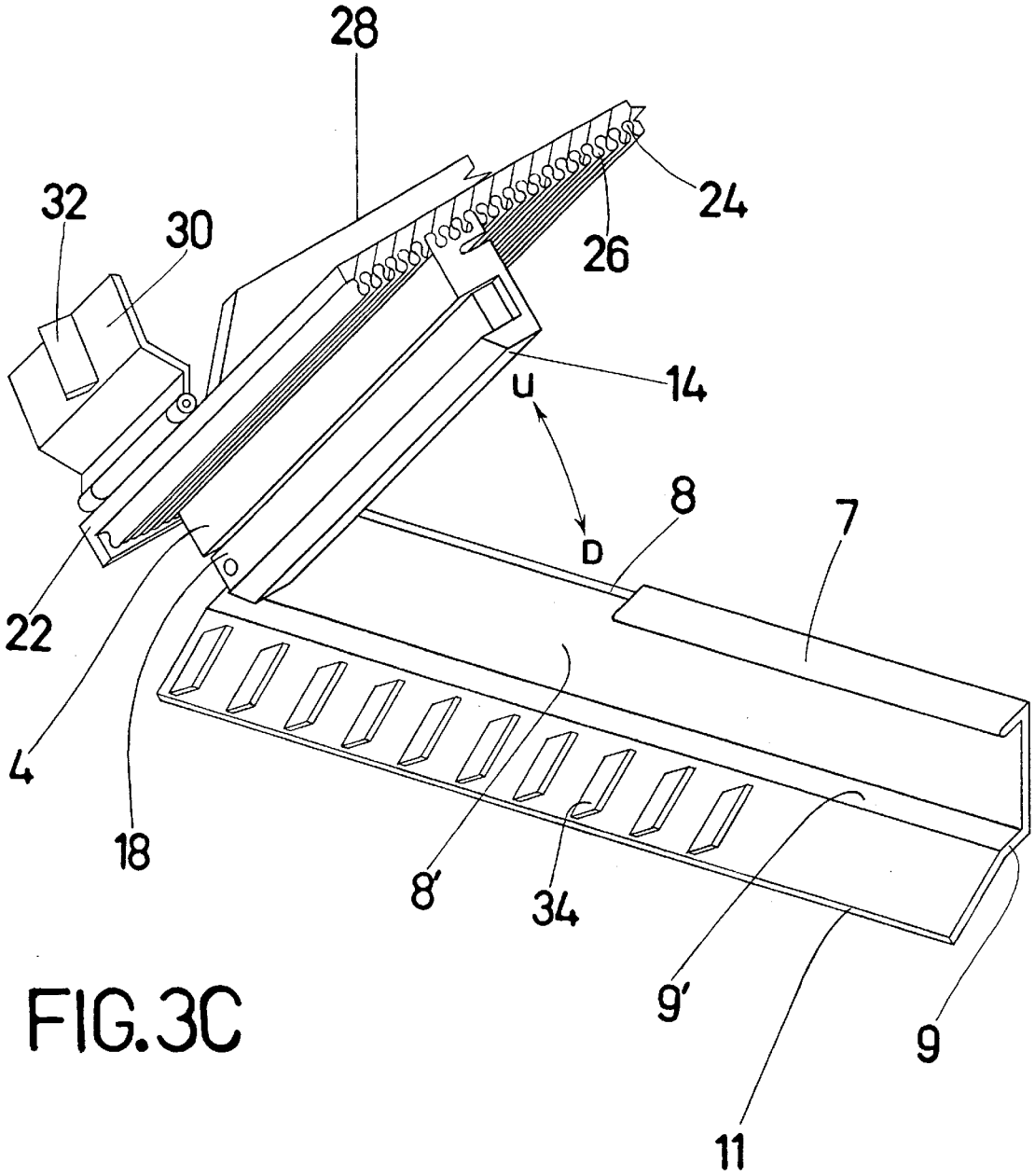
FIG. 3C is an isometric view of the symmetrical track shown in FIG. 3B, but with its corresponding slidable member and attached bridge member in an upwardly rotated position. Only a portion of bridge member is shown due to a conventional break down its mid-section and with its back section removed.
Figure 4:
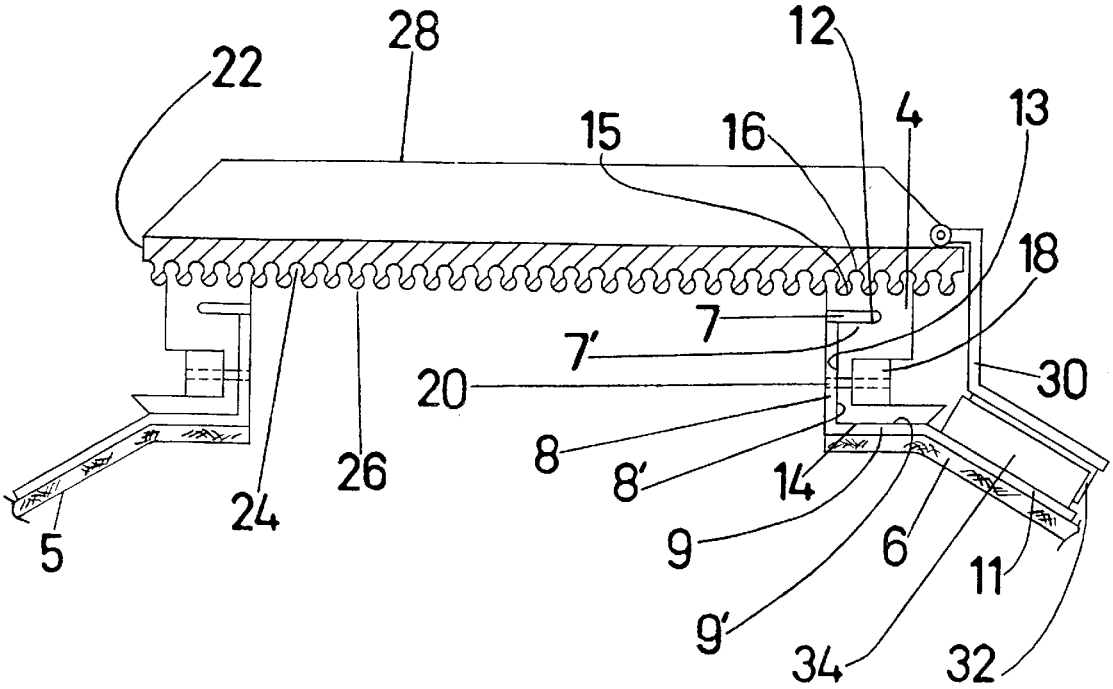
FIG. 4 is a frontal view of the first embodiment of the invention with an exposed frontal section of bridge member.

With reference to FIGS. 3A and 3B it can be seen that slidably located within track (2) is a slidable member (4), and as can be seen in FIG. 4, member (4) which contains three contact surfaces (12), (13), and (14) that are parallel to, and come into contact with, surfaces (7'), (8'), and (9') respectively. With particular attention being paid to FIG. 3A it can be seen that although the main body of member (4) lies within the partial enclosure formed by adjacent surfaces (7'), (8'), and (9) which restricts its movement to along track (2), it has a top surface which lies well beyond and above track member (7), and where in said top surface is formed a series of longitudinal grooves (15) and protuberances (16) where (15) and (16) are all parallel to each other. Again referring to FIGS. 3A, 3B, and 3C it is shown that slidable member (4) is the longitudinally extendable and retractable member of a telescopically extendable member which itself comprises two members (4) and (18). The other member (18) is fundamentally an elongate cuboid structure to which (4) is secured, and along whose longitudinal axis (4) slidably extends from and retracts towards an axis of rotation (20). Member (18) is pivotally secured about (20), and (20) is located on surface (8) near the end of that surface located towards front of shoe which is indicated by arrow F in FIG. 3B. Axis (20) is perpendicular to planar surface (8) as seen in FIG. 4 thus enabling pivotally secured member (18) to pivot in a plane parallel to that of surface (8) and thereby providing a means of rotation for (4) where (4) can rotate in a plane parallel to that of (8). Movement of (4) becomes restricted to along track (2) as (4) moves in the direction towards back of shoe as denoted by arrow B in FIG. 3B. This happens because planar members (7) and (9) as shown in FIGS. 3C and 4 prevent (4) from rotating in a vertical plane and also because there are no means allowing (4) to move laterally relative to track (2). However with (4) fully retracted and reaching the limit of its movement in the direction of arrow F an aperture in track (2) formed by the omission of the length of track member (7) as indicated by parenthesis (36) shown in FIGS. 3A and 3B permits (4) to dislodge from (2) in a plane parallel to that of surface (8) and rotate upwards as denoted by arrow U in FIG. 3C.

Figure 5:
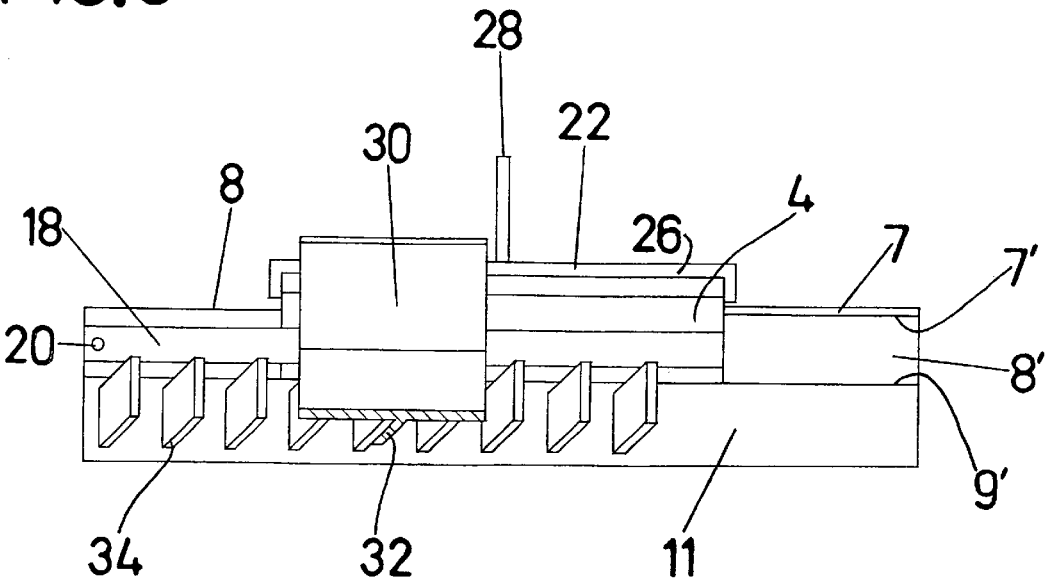
FIG. 5 is a side view of device with showing the lever in its filly downwards rotated position.

Laterally securing slidable extendable/retractable members (3) and (4) at a predetermined distance apart is a bridge member (22) as shown in FIGS. 4 and which is also partly shown in FIG. 3C. Paying particular attention to FIGS. 4 and 3C it is seen that located in the undersurface of bridge member (22) is a series of longitudinal grooves (24) and protuberances (26) which are all parallel to each other, as well as similar to, and interlockingly engageable with, the grooves(15) and protuberances (16) located on the top surfaces of (3) and (4). Referring to FIGS. 1, 4 and 5 it is shown that located on the top surface of (22) is a handle (28) which can be described as a symmetrical trapezium shaped planar member that is transversely and perpendicularly situated on the top surface of (22).

By positioning the undersurface of (22) so that it faces top surfaces of (3) and (4) and orientating it so that the grooves (24) and protuberances (26) located on its undersurface are parallel to grooves( 15) and ridges (16) located on top surfaces of (3) and (4), and by directing said undersurface towards top surfaces of (3) and (4) with small applied force, the grooves (24) and protuberances (26) in undersurface of (22) interlock with grooves (15) protuberances and (16) in top surfaces of (3) and (4) as shown in FIG. 4 and 3C. Once attached to bridge member all movement of (3) and (4) can be controlled via (28).

Pivotally secured near one of the longitudinal edges of (22) is a pawl means (30) whose axis of rotation is parallel to the grooves and ridges located on underside of (22) as can be seen in FIGS. 3C and 4. The pawl means (30) has an undersurface on which is appendaged an operative portion (32) as indicated in FIG. 3C. As illustrated in FIG. 5 when (30) reaches its limit of downward rotation the operative portion (32) engages one of a series of ratchet like tooth members (34) linearly arranged along top surface of (11) in such a way that the longitudinal movement of lever (30) and bridge member (22) to which (30) is secured, and consequently (3) and (4) along a path parallel to track is restricted to one direction only which is towards back of shoe and denoted by arrow B.

DESCRIPTION OF OPERATION OF FIRST EMBODIMENT

In its normal unfastened state a shoe's flap portions are loose and not directed towards each other, but instead tend to be directed away from the longitudinal median of shoe as a result of the constant pulling apart of flaps necessary for placement into, and subsequent removal thereof of foot from shoe. For fastening to occur and remain constant the opposing flap portions of a shoe must be directed together and remain in that state. Once fastening occurs and opposing flap portion of shoe are directed towards each other the flaps become taut and are separated by a minimum distance S as shown in FIG. 2. The slidable members as previously described in the detailed description above are secured apart laterally from each other at a predetermined optimum distance so that when bridge member is rotated downward in the direction of the arrow D in FIG. 3C the opposing flap portions of associated shoe are separated by distance S. The predetermined distance can be found by trial and error or by taking measurements.

With (3) and (4) secured to (22) and laterally set apart at predetermined optimum distance as shown in FIG. 4, as well as fully retracted and in upwardly rotated position, the description of operation will now take place. Bridge member (22) is rotated downwards and as a consequence (3) and (4) gradually become parallel to, and slidably located within tracks (1) and (2) respectively. Consequently members (I) and (2) with respectively secured flap portions (5) and (6) are gradually directed towards each other until they become aligned with (3) and (4) and are parallel to each other. Total alignment of (I) and (2) occurs when (3) and (4) are parallel to, and slidably located within each's respective track as is illustrated in FIG. 1. Once this occurs and via usage of (28), bridge member (22), and consequently (3) and (4) are directed towards back of shoe until the resultant lateral forces directed towards the longitudinal median of shoe are distributed evenly throughout tracks (1) and (2) and consequently throughout the respective flap portions (5) and (6) to which they are secured. At this time pawl means (30) is rotated downwards so that operative portion (32) becomes with engaged to one of the tooth members (34) located on top surface of (11) as shown in FIG. 5. This prevents (30), (22), (3) and (4) from sliding towards front of shoe, but allows slidable movement towards back of shoe, in effect resisting the natural tendency of mechanism to unfasten itself during regular wear of shoe. To loosen shoe, (30) is rotated upwards which causes disengagement of (32) from (34) and thereby permitting movement of (30), (22), (3) and (4) in either direction along track. Using handle (28), the bridge member (22) is slid in a direction towards front of shoe and upon reaching limit of its movement in this direction whereupon (3) and (4) are fully retracted, (22) is rotated upwards consequently dislodging (3) and (4) from (1) and (2) respectively, and subsequently allowing flap portions (5) and (6) which are attached to (1) and (2) respectively to return to their normal relaxed unfastened state whereby foot can be removed from shoe.

DESCRIPTION OF SECOND EMBODIMENT

Figure 6A:
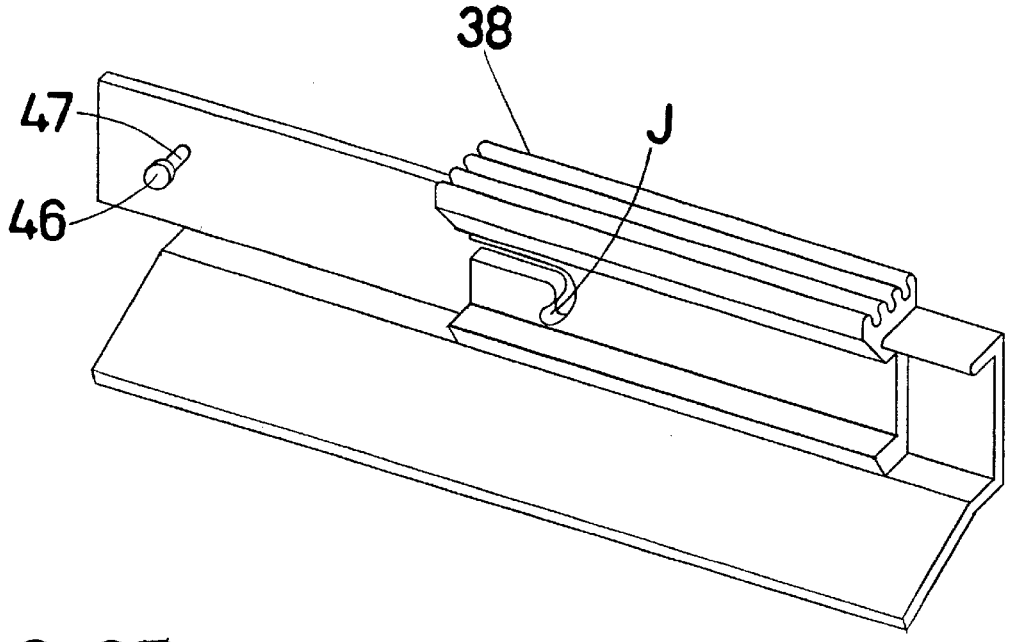
FIG. 6A is an isometric view of one symmetrical track of the second embodiment of the invention with its slidably located corresponding slidable member slidably positioned towards back of track.
Figure 6B:
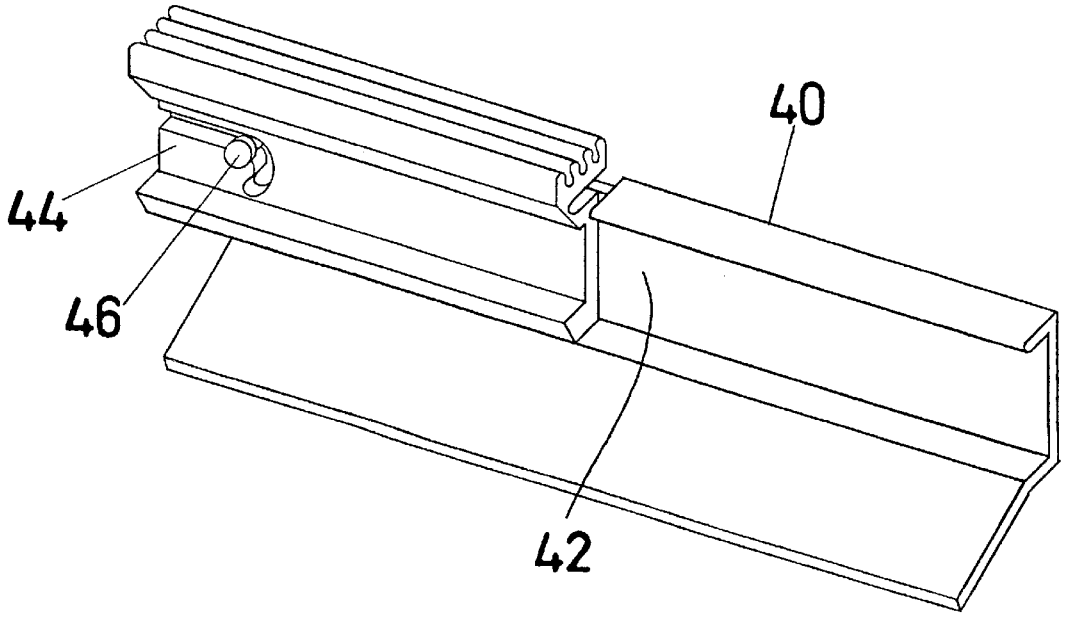
FIG. 6B is an isometric view of the symmetrical track in FIG. 6A with its slidably located corresponding slidable member slidably positioned towards front of track.
Figure 6C:
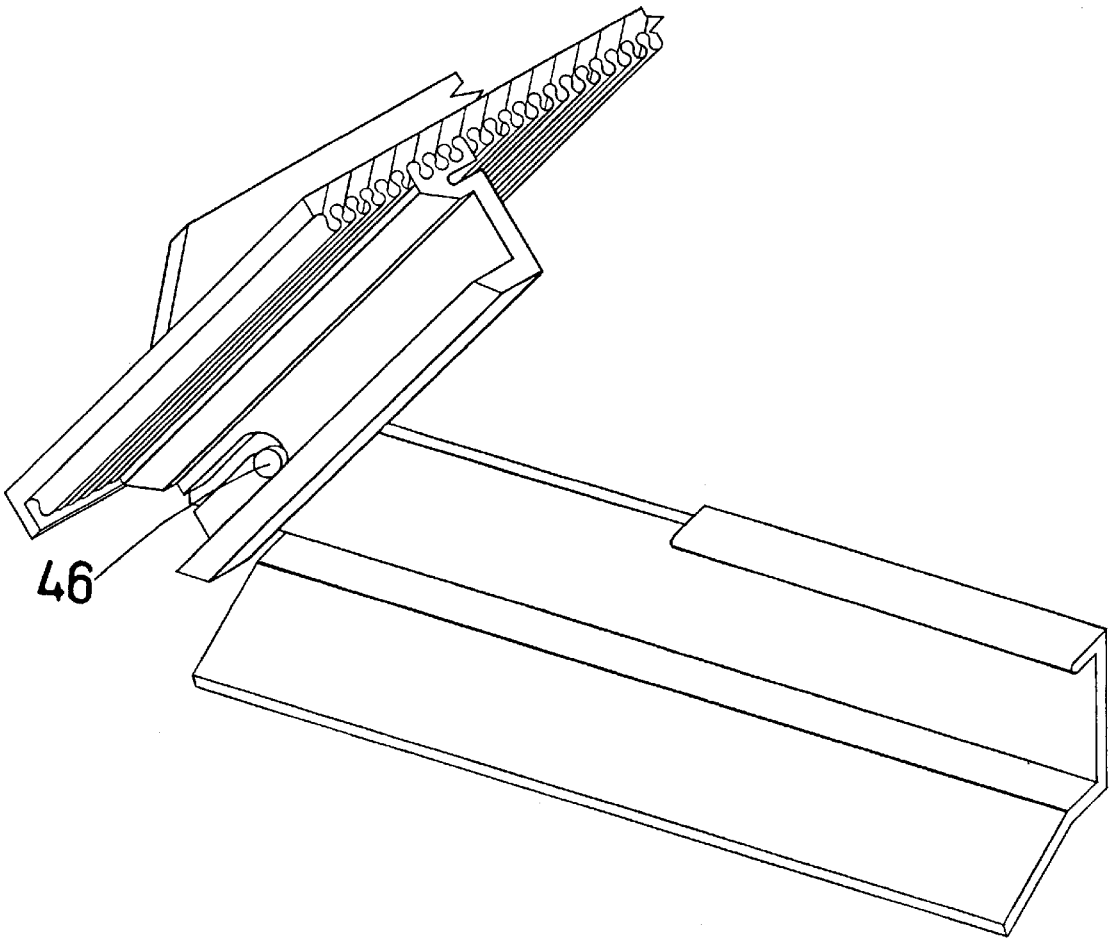
FIG. 6C is an isometric view of the symmetrical track of FIG. 6B with its corresponding slidable member and attached bridge member in an upwardly rotated position. Only a portion of bridge member is shown due to a conventional break down its mid-section, and with its back section removed.

This second embodiment is very similar to the first in that all similar or identical parts located on both embodiments serve exactly the same functions. In the second embodiment however parts (30) and (34) whose functions serve in a locking capacity and which do not play an integral part in effecting fastening are omitted with more focus being given to the difference of the slidable members which is the only difference between the second and first embodiments barring the omission of (30) and (34). One of the slidable members of the second embodiment (38) is shown in FIGS. 6A, 6B, and 6C. It contains contact surfaces similar to those of (4) and a top surface which lies well beyond and above top track member and in which is formed a series of longitudinal grooves and protuberances also similar to (4), but whereas in the first embodiment slidable member (4) was described as being the longitudinally extendable and retractable member of a telescopically extendable member where telescopically extendable member consisted of two members (4) and (18), and where (18) was pivotally secured to (2), and where (4) was secured to (18), slidable member (38) is not part of any telescopically extendable system. Member (38) has a longitudinal midsection with vertical opposing planar surfaces parallel to vertical surface (42)of track (40) as shown in FIG. 6B. One of the opposing vertical surfaces of (38) is referenced by number (44) in FIG. 6B and can be seen in FIGS. 6A and 6C. The other opposing planar surface which is not clearly shown in any of the drawings is similar to surface (13) of member (4) as seen in FIG. 4 and can be described as the surface of (38) that comes into contact with track surface (42) when (38) is slidably positioned within track. Again referring to FIGS. 6A, 6B, and 6C, a peg like member (46) is perpendicularly appendaged to surface (42) near the end of that surface towards front of shoe where it forms an axis of rotation about which rotation in a plane parallel to surface (42) can take place. Formed in the longitudinal mid-section of member(38) is a longitudinal J shaped slot (J). This slot bifurcates the end of(38) located toward the front of shoe. When (38) is slid towards front of shoe, slot (J) slidably engages peg like member (46) in such a way that the shaft of peg like member translates a path through the open end of J formed in the cross-section of (38), and continues in a straight path along length of slot as illustrated in FIG. 6B. Upon reaching the limit of slidable movement towards front of shoe slot (J) pivotally engages peg (46) in such a way that engagement permits (38) to rotate upwards in a vertical plane and dislodge from track as peg traces a curved path of rotation along curved length of slot (J).

DESCRIPTION OF OPERATION OF SECOND EMBODIMENT

With the exception of lever (30) and ratchet like tooth members (34) which were left out of the description of the second embodiment so as to focus mainly on the one inherent difference between the first and second embodiments, the description of operation of the second embodiment is similar to that of the first, and as such a more concise description of operation will be attributed to the second embodiment with the understanding that the functions of similar or identical parts do not change. It should also be noted that even though bridge member, (22) is omitted in FIGS. 6A and 6B it is to be understood that the general movement of the slidable members occurs via (22).

The slidable members are attached to the underside of bridge member and laterally spaced apart at previously described predetermined optimum distance. Starting with bridge member (22) in upwardly rotated position as shown in FIG. 6C, (22) is rotated downwards until limit of downward rotation is reached and slidable members are slidably located within their respective tracks. Each track is attached to an opposing flap of an associated shoe. As downwards rotation of slidable members take place however each track and its respective attached flap is directed towards the other effecting fastening of shoe. With slidable members slidably located in their respective tracks and with each track aligned and parallel to its respective slidable member, slidable members are slid in a direction towards back of shoe as (38) is shown done in FIG. 6A, so as to prevent slidable members from inadvertently rotating upwards and dislodging from their respective tracks. To unfasten shoe slidable members are slid towards front of shoe as (38) is shown done in FIG. 6B, and upon reaching their limit of movement in this direction are rotated upwards as (38) is shown done in FIG. 6C resulting in the unfastening of shoe thereby allowing removal of foot from it.

MODIFICATIONS TO THE SECOND EMBODIMENT

Figure 7:
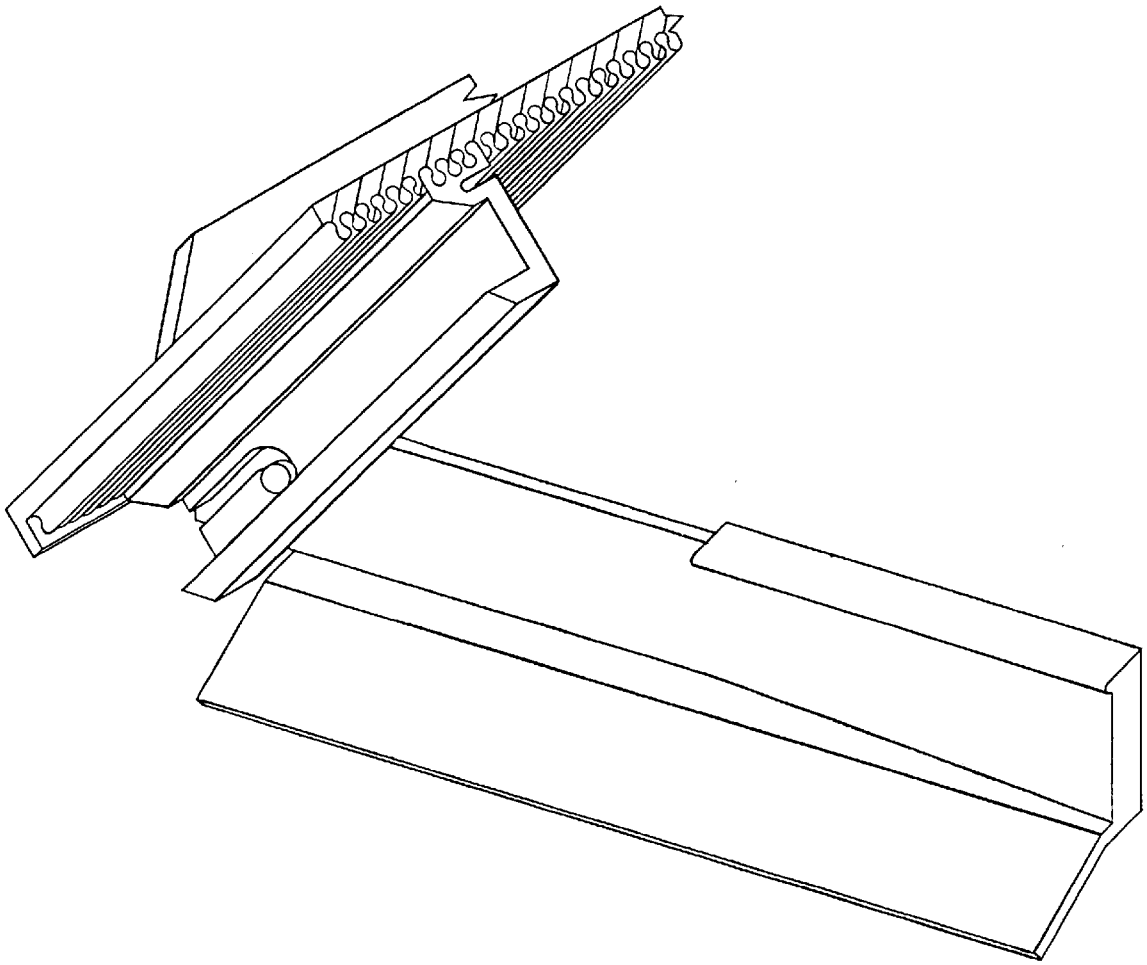
FIG. 7 is an isometric view of one symmetrical track of the second embodiment of the invention with a modification to the vertical track surface whereby said surface deviates outwards the further surface is from front of track.

FIG. 7 shows a modification to the vertical track surface of the second embodiment. In this modification said surface deviates outwards the further surface is from front of shoe. The advantage of this design over the previously described designs is that the lateral displacement of tracks (with respectively attached flaps) per unit distance traveled along tracks by slidable members is greater resulting in more rapid fastening or loosening of shoe depending on which direction along tracks slidable members are slid.

Figure 8:
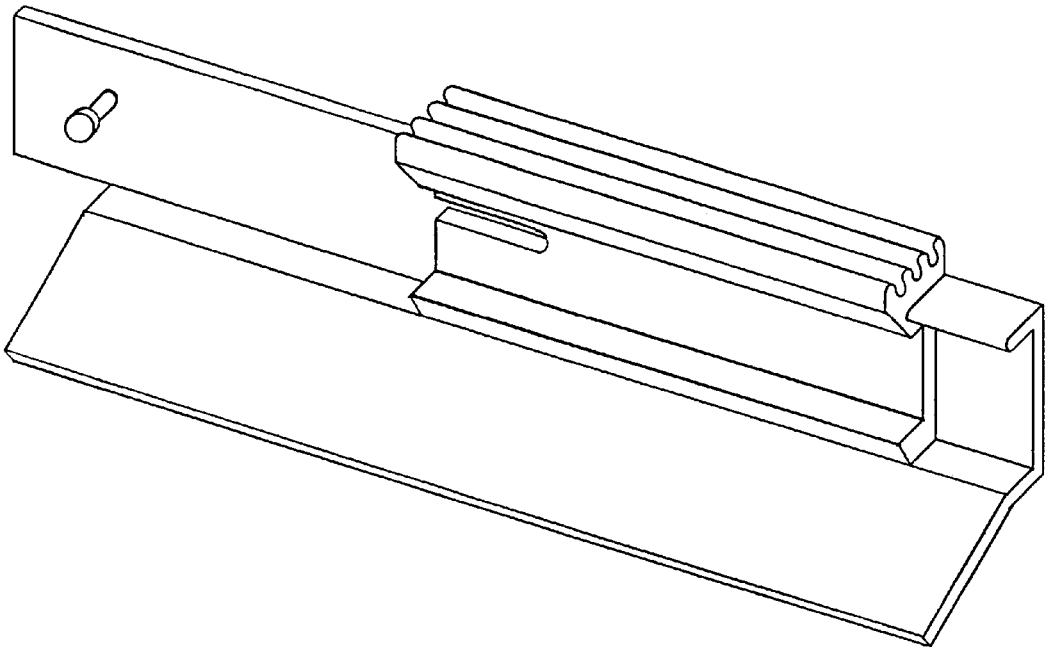
FIG. 8 is an isometric view of one symmetrical track of the second embodiment of the invention with corresponding slidable member where corresponding slidable member has a straight slot rather than the J shaped slot illustrated in FIGS. 6A, 6B and 6C.

FIG. 8 shows a modification of the J shaped slot as described in the second embodiment. In this modification the J shaped slot as seen in FIGS. 6A, 6B, and 6C is replaced by a straight slot which produces the same result with regards to the rotation of slidable members. The J slot design however has an advantage over the straight slot design whereby due to its curvature, when slidable members are in an upwardly rotated position they would tend to stay in that position unless prompted to do otherwise with the application of small force. With the straight slot design however, when slidable members are in the upwardly rotated position they would tend to rotate back downwards under force of gravity.

What is claimed is:

1. A shoe fastening device for directing together dual opposing flap portions of a shoe incorporating device whereby said device comprises two elongate alignment members essentially parallel to each other and laterally spaced apart at a fixed distance whereby both lie in and define a first plane and each of said alignment members defining at least one surface or component thereof parallel to and facing a longitudinal median situated between them, and two elongate flap members each longitudinally securable to an opposing flap of said shoe whereby both lie in and define a second plane and each of said flap members defining at least one surface or component thereof parallel to and facing away from said longitudinal median whereby said longitudinal median is concurrently a longitudinal median of said elongate flap members, and an axis of rotation defined where said first plane and said second plane intersect said axis being perpendicular to said elongate alignment members and essentially perpendicular to said elongate flap members and whereby said axis of rotation traverses through near similarly located longitudinal ends of said elongate alignment members and through near similarly located longitudinal ends of said elongate flap members and about which said elongate alignment members and said elongate flap members are pivotally secured and whereby at said axis the distance between said surfaces or components thereof of said elongate alignment members that are parallel to and facing said longitudinal median is greater than that between the surfaces or components thereof of said elongate flap members that are parallel to and facing away from said longitudinal median.

2. The device of claim 1 where said elongate flap members comprise a pair of longitudinal tracks within which and along whose longitudinal axes a pair of extendable/retractable members can extend and retract, and where said elongate alignment members comprise a pair of extendable/retractable members which can extend and retract longitudinally along axes parallel to said longitudinal median.

3. The device of claim 2 where said elongate alignment members are situated laterally apart from each other by means of a bridge member to which they are secured.

4. The device of claim 3, where the securing to bridge member of said elongate alignment members is achieved by a detachable interlocking engagement of grooves and protuberances located on upward surfaces of said elongate alignment members with corresponding grooves and protuberances found in the undersurface of bridge member.

5. The device of claim 2, where the surfaces of said elongate flap members parallel to and facing away from said longitudinal median laterally deviate away from said longitudinal median the further away said surfaces are from said axis.

6. The device of claim 2 where located on a longitudinal surface of said device that is longitudinally immobile relative to said extendable/retractable members is a series of ratchet like tooth members, and where located on a part of said device that is longitudinally mobile relative to said entendable/retractable members is a pawl means said pawl means having a operative portion to engage at least one of said tooth members.

7. The device of claim 1 where said elongate flap members comprise a pair of longitudinal tracks within which and along whose longitudinal axes a pair of slidable members can slide, and where said elongate alignment members comprise a pair of slidable members slidable along axes parallel to said longitudinal median.

8. The device of claim 7 where said elongate alignment members are situated laterally apart from each other by means of a bridge member to which they are secured.

9. The device of claim 8, where the securing to bridge member of said elongate alignment members is achieved by a detachable interlocking engagement of grooves and protuberances located on upward surfaces of said elongate alignment members with corresponding grooves and protuberances found in the undersurface of bridge member.

10. The device of claim 7, where the surfaces of said elongate flap members parallel to and facing away from said longitudinal median laterally deviate away from said longitudinal median the further away said surfaces are from said axis.

11. The device of claim 7 where located on a longitudinal surface of said device that is longitudinally immobile relative to said slidable members is a series of ratchet like tooth members, and where located on a part of said device that is longitudinally mobile relative to said slidable members is a pawl means said pawl means having a operative portion to engage at least one of said tooth members.

* * * * *